United States Patent [19]

Tasma

[11] 4,326,133

[45] Apr. 20, 1982

[54] CONTROL CIRCUIT FOR ALTERNATELY ACTUATING A PAIR OF LOADS

[75] Inventor: James D. Tasma, Grand Rapids, Mich.

[73] Assignee: Rospatch Corporation, Grand Rapids, Mich.

[21] Appl. No.: 72,839

[22] Filed: Sep. 6, 1979

[51] Int. Cl.[3] ..... H01H 47/04

[52] U.S. Cl. ..... 307/26; 361/155; 361/167; 361/194; 307/41; 307/142

[58] Field of Search ..... 307/26, 29, 142, 41; 361/155, 167, 194

[56] References Cited

U.S. PATENT DOCUMENTS 2,801,372 7/1957 Renick et al. ..... 361/155

*Primary Examiner*—Michael L. Gellner
*Assistant Examiner*—James L. Dwyer
*Attorney, Agent, or Firm*—Price, Heneveld, Huizenga and Cooper

[57] ABSTRACT

A control circuit for alternately actuating a pair of loads includes a voltage doubling circuit having a capacitor common to a pair of charge storage devices and switch means which are alternately actuated to discharge the charge storage devices through a pair of loads. Coupled to the circuit is a holding current power supply for maintaining the loads in an actuated position once the charge storage devices are discharged. The circuit thus provides an initially high current pulse for rapidly actuating inductive loads such as solenoids.

19 Claims, 3 Drawing Figures

CONTROL CIRCUIT FOR ALTERNATELY ACTUATING A PAIR OF LOADS

BACKGROUND OF THE INVENTION

The present invention relates to an electrical circuit and particularly to an electrical circuit for alternately actuating a pair of loads with an initially high actuating current followed by a lower holding current.

In industries such as the label printing industry, it is desired to rapidly stepwise advance a web of label material through a printing press or a label cutting machine. In order to advance the web at a speed sufficiently rapid to provide a large volume output of relatively small labels it can be appreciated that the web material must move rapidly into, for example, printing stations or label cutting stations. Naturally, the web feeding mechanism must position the web accurately for successive printing and/or cutting operations. Thus, for example, for printing an accuracy of 0.005 of an inch registration is required particularly where multi-colored printing is being employed.

In the past, a variety of feed mechanisms have been employed for feeding, for example, labels through a label cutting machine. Rollers which selectively advance the web stock label material have been employed and include a moveable idler roller to alternately compress the stock between a driven roller and the idler roller and release it for advancing and stopping the web, respectively. With such prior art, however, where complex mechanical linkages are used, only approximately 300 labels per minute can be run through the device. Representative of such prior art machines is the present assignee's Model No. CF-180.

In order to significantly increase the speed of operation of such machines, it has been discovered that electrical drive of the pinch roller directly on a slide and/or clamping mechanism for holding the web stock in position is desired. Operation of electrically driven solenoids, however, is relatively slow unless such solenoids are actuated with an initial high current impulse followed by a lower holding current. The concept of providing this type of actuation for solenoids is well known as are some types of electrical circuits to provide such operation. Representative of such prior art are U.S. Pat. Nos. 3,599,804, issued Aug. 17, 1971 to P. O. Chorney; 3,248,633, issued Apr. 26, 1966 to J. J. Guarrera; 4,001,664, issued Jan. 4, 1977 to T. M. Hyltin; and 3,411,045, issued Nov. 12, 1968 to N. L. Reyner.

It has also been discovered that in order to speed up the operation of label printing and cutting machines, it is desirable not only to electrically direct drive the means for advancing the web stock through the machine, but also electrically drive clamping mechanism for stopping and holding the web stock in registration. The drive means and the clamping means are alternately operated for the stepwise advancement of the web stock material.

SUMMARY OF THE PRESENT INVENTION

The control system of the present invention provides an electrical control circuit which alternately provides a high current impulse and a subsequent lower holding current alternately supplied to a pair of loads. The circuits embodying the present invention include a common voltage doubling charge storage device selectively coupled to a pair of charge storage devices and means for alternately coupling the charge storage devices to a pair of loads for providing an initially high current impulse from the charge storage devices. The circuit includes a holding current power supply for providing a holding current to the loads after initial actuation. When employed with inductive loads such as solenoids for feeding mechanism and holding mechanism of web feeding apparatus, the circuit of the present invention permits a significantly higher speed operation of such machinery. These and other features, advantages and objects of the present invention will be best understood by reference to the following description thereof together with the accompanying drawings in which:

DETAILED DESCRIPTION OF THE PREFERRED EMBODIMENT

Figure 1:
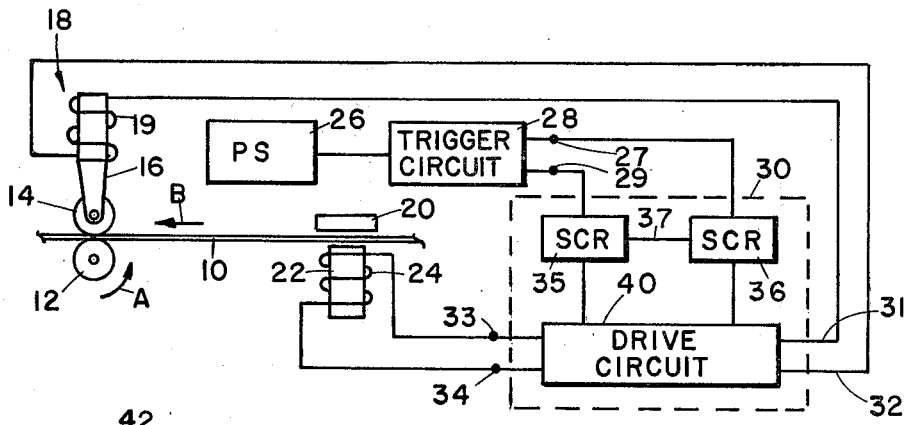
FIG. 1 is an electro-mechanical diagram in block and schematic form of a system embodying the present invention.

Referring initially to FIG. 1, there is shown a web advancing mechanism for web stock material 10 which is advanced between a drive roller 12 continuously driven by a suitable motor in a counterclockwise direction as indicated by arrow A in the Fig. to advance the web stock 10 in the direction indicated by arrow B. The web stock is advanced by the vertical movement of a slide mounted pinch roller 14 mounted to the armature 16 of a solenoid 18. Solenoid 18 includes a coil 19 which is coupled to a control circuit 30 by means of terminals 31 and 32. Upon actuation of coil 19 by the control circuit, pinch roller 14 will compressively engage the web 10 between it and the drive roller 12 to advance the web stock in the direction indicated by arrow B.

In the preferred embodiment, the drive mechanism so described is employed for cutting pre-printed labels formed on the web stock material which typically is a fabric. The labels are cut from the web stock by cutting mechanism located downstream of the feed drive for providing individual labels applied, for example, to clothing or the like. In addition to the feed mechanism, there is provided a clamping means comprising a vertically moveable ferro-magnetic plate 20 which is suitably guidably positioned above the web stock and which is forced downwardly against the pole piece 22 of an electro-magnet including an actuating coil 24 to compressively hold the web stock 10 in a stationary registered position. Coil 24 is coupled to output terminals 33 and 34 of the control circuit to receive electrical control signals therefrom. Coils 19 and 24, thus, are activated alternately to provide stepwise advancement and holding of the web stock in precise registered position.

In order to control the timing of the advancement and positioning of the web stock, a photocell detector 26 is positioned to detect printed indicia on the web stock material preferably in a position immediately adjacent the feeding mechanism comprising rollers 12 and 14. The photoelectric detector provides an output control signal upon detection of a visible indicia on the web stock and applies this control signal to a trigger circuit 28 having output terminals 27 and 29.

Trigger circuit 28 can be of a conventional design and includes a suitable wave-shaping input circuit coupled to the output of the photocell detector 26 and a pre-settable monostable multivibrator such that it will provide an output pulse at terminal 27 employed to activate coil 24 when the web stock is to be stopped and simultaneously deactuate coil 19 to release the pinch roller from drive wheel 12 such that no forward drive is applied to the web. After a predetermined delay time sufficient to provide the cutting operation or whatever operation is being performed on the web, the trigger circuit provides an output pulse at terminal 29 causing the deactuation of coil 24 and activation of coil 19 to advance the web an incremental distance whereupon the activated state of the coils is again reversed.

The output signals on terminals 27 and 29 of trigger circuit 28 are applied to the control circuit 30 having output terminals 31 through 34, as noted above. The control circuit 30 includes a pair of SCRs 35 and 36, which are cross coupled as indicated by interconnection 37 in a conventional manner such that actuation of one of the SCR's starves the anode-to-cathode current of the remaining SCR, thereby turning the remaining SCR off. Thus, upon actuation of either of the SCR's by signals from output terminals 27 and 29 of trigger circuit 28, the remaining SCR will be rendered non-conductive. The cross coupling of the SCRs is conventional and can generally be as disclosed in the SCR Manual, 5th Edition, published in 1972, by the General Electric Company. The block diagram representation of the SCRs is not intended to represent the individual anode, gate and cathode terminals, but is illustrative only. Each of the SCRs 35 and 36 provide, in essence, a switch contact closure between the anode-to-cathode current path which closure is coupled to a drive circuit 40 which responds to the SCR conduction to provide the operating power for relay coils 19 and 24. Drive circuit 40 is shown in detail in FIG. 2, where SCRs 35 and 36 are represented as switches 35 and 36 which circuit is now described in greater detail in connection also with the voltage and current wave-form diagram of FIG. 3.

Figure 2:
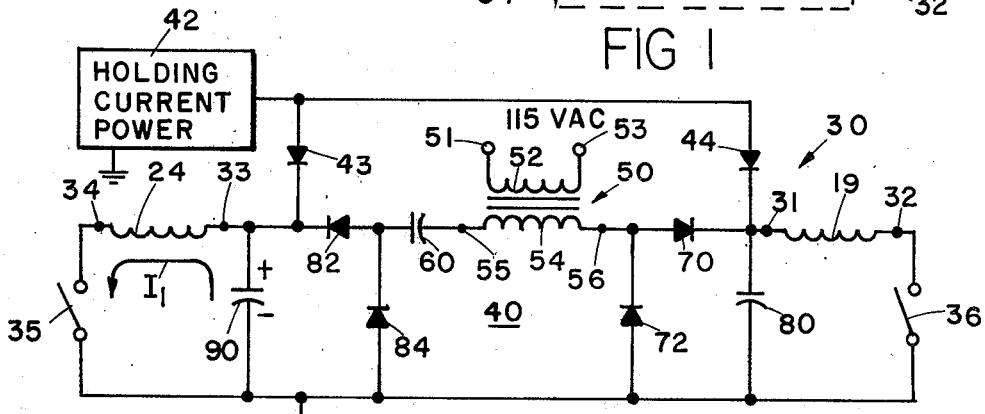
FIG. 2 is an electrical circuit diagram partly in block and schematic form of the control circuit of the present invention.

The drive circuit 40 shown in FIG. 2 includes a direct current (DC) voltage supply 42 having a negative terminal grounded and a positive terminal providing approximately a +12 V DC voltage output in the preferred embodiment to relay coils 24 and 19 through steering diodes 43 and 44 and switches 35 and 36 to ground. The steering diodes each have their anodes coupled to the positive output terminal of the holding current supply 42 and their cathodes coupled to terminals 33 and 31 of coils 24 and 19, respectively. The remaining terminals 34 and 32 of the coils 24 and 19, respectively, are coupled through the SCRs 35 and 36 to ground to provide when one of the SCRs is in a closed position, a DC current flow path from the holding current power supply 42 through the respective activated relay coil.

The drive circuit 40 also includes an instantaneous peak current supply including an AC source comprising a step up transformer 50 having a primary winding 52 coupled to a 115 V AC supply through input terminals 51 and 53. The secondary winding 54 of transformer 50 has a first terminal 55 coupled to one side of a voltage doubling charge storage device comprising a capacitor 60, while its remaining terminal 56 is coupled to the junction of unidirectional conductive devices comprising diodes 70 and 72, respectively. Diode 70 has its anode coupled to terminal 56 with its cathode coupled to output terminal 31, which is also coupled to ground through a charge storage device such as a capacitor 80. Diode 72 has its cathode coupled to terminal 56 and its anode coupled directly to ground.

Figure 3:
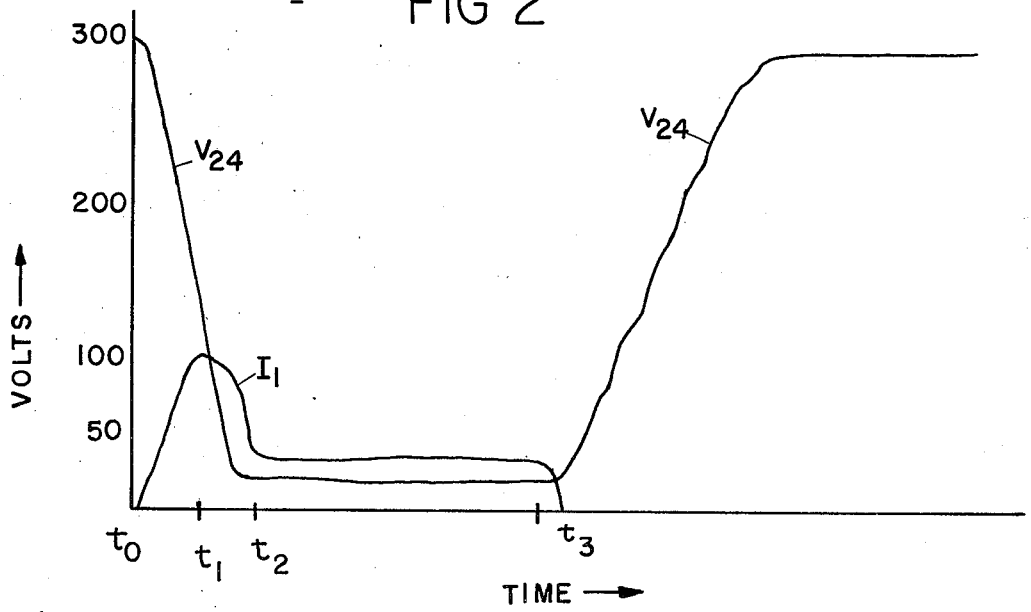
FIG. 3 is an electrical waveform diagram illustrating the operation of the circuit shown in FIG. 2.

The remaining side of capacitor 60 is also coupled to a pair of unidirectional conductive devices comprising diodes 82 and 84 with diode 82 having its anode coupled to capacitor 60 and its cathode coupled to output terminal 33. Terminal 33 is also coupled to ground by means of a charge storage device such as a capacitor 90. Diode 84 has its cathode coupled to the junction of diode 82 and capacitor 60 and its anode coupled to ground. As described below the charge storage devices 60, 80 and 90 provide a relatively high instantaneous current pulse to relay coils 19 and 24 when switched into the current circuit by actuation of SCRs 35 and 36. The charged storage device 60 is a voltage doubler capacitor common to and sequentially switched between capacitors 80 and 90 for providing a high current and voltage impulse to the relay coils 19 and 24 initially to provide fast acting web drive and clamping operation for the system shown in FIG. 1. Having described the electrical interconnection of the elements comprising the drive circuit, a detailed description of the operation of the drive circuit in connection with FIG. 3, is now presented.

OPERATION

Assuming, for initiation of the description of the operation of the circuit shown in FIG. 2 that SCR 35 has been activated the switch 35 in FIG. 2 thus would be in a closed position for activating coil 24 clamping the web stock in position. This occurs immediately after the photocell 26 detects a condition indicating the web stock is positioned for an operation to be performed while stationary. Prior to this time, capacitor 90 has been charged to approximately 300 volts through a charging path including capacitor 60, secondary winding 54, diode 82, and diode 72. Thus, capacitor 90, which in the preferred embodiment is a 350 micro-farad capacitor, discharges in a current loop including capacitor 90, switch 35 and coil 24 with a current shown as $I_1$ in FIG. 2 flowing in a counterclockwise direction. The current wave-form diagram $I_1$ is shown in FIG. 3, where the voltage across capacitor 90 is shown as $V_{24}$ which is in parallel to coil 24 when switch 35 is closed at time $t_0$.

At a time $t_1$ corresponding to approximately 1 millisecond in the preferred embodiment, $I_1$ has reached a peak current through relay coil 24 which peak is slightly lagging behind the peak voltage $V_{24}$ applied across the inductive load. As capacitor 90 rapidly discharges, at a time $t_2$, the current $I_1$ is maintained at a holding level as is the voltage $V_{24}$ which corresponds to the voltage applied to the coil from the holding current power supply 42. Thus, after the initial voltage and current peak applied to coil 24 for rapid actuation of the clamp 20, the clamp is held in a web clamping position by the holding current.

At the same time switch 35 is conductive, diode 72 is also conductive during a half cycle when the polarity of terminals 55 and 56 of transformer 50 is positive and negative, respectively, to provide a DC charge on capacitor 60 which renders terminal 55 at a positive DC level. Capacitor 60 is in the preferred embodiment approximately a 40 micro-farad capacitor and is charged during activation of coil 24 for subsequently providing a voltage doubling charge on capacitor 80 during an alternate half cycle of voltage at terminals 55 and 56 of the transformer 50. This occurs when the charge from capacitor 60 is transferred to capacitor 80 together with the voltage across secondary winding 54 through diodes 84 and 70 to charge capacitor 80 to approximately 300 volts during the time period $t_0$ through $t_3$, which can be any time necessary for performing the required operation on the web stock material. SCR 36 is then actuated at a time $t_3$ by a signal from trigger circuit 28 through output terminal 27 to close switch 36 at which time switch 35 opens. At time $t_3$ when SCR 36 is actuated to apply current to relay coil 19 for advancing the web stock, the voltage $V_{24}$ is increased to the approximate 300 volt level by subsequent charging of capacitor 90 through voltage doubling capacitor 60 and diodes 72 and 82 in a manner similar to the charging of capacitor 80 when SCR 35 is actuated.

The cycle is thus repeated with SCR 35 and 36 alternately actuated for discharging their respective capacitors 90 and 80 through coils 24 and 19, respectively, while the capacitor not coupled in circuit with a coil is being charged to approximately 300 volts through the voltage doubling capacitor and associated diodes. Capacitor 80, like capacitor 90, has a value of approximately 350 micro-farads to provide a relatively high energy storage for providing an initial current pulse through the inductive loads sufficient to rapidly actuate either the spring returned pinch roller 14 to contact drive roller 12 of the clamp 20. The time $t_0$–$t_3$ during which the web is being advanced or held for cutting, printing or other operation being performed, is sufficiently long to permit the alternate recharging of one of the drive capacitors 80 and 90 while the other capacitor discharges.

It will become apparent to those skilled in the art that various modifications to the preferred embodiment of the present invention described herein can be made without departing from the spirit or scope thereof as defined by the appended claims.

The embodiments of the invention in which an exclusive property or privilege is claimed are defined as follows:

1. A circuit for alternately and repetitively actuating a pair of loads to provide continuous alternate operation of the loads, said circuit comprising:

a source of AC current;

a voltage doubling charge storage device coupled to said source;

a charge storage device;

a first pair of unidirectional conductive devices coupling said source of AC current to said voltage doubling charge storage device and said first charge storage device in a first voltage doubling circuit;

a second charge storage device;

a second pair of unidirectional conductive devices coupling said source of AC current to said voltage doubling charge storage device and said second charge storage device in a second voltage doubling circuit; and means for alternately coupling said first and second charge storage devices to first and second loads, said coupling means including first and second alternately actuatable switch means for alternately and repetitively coupling said first and second charge storage devices to first and second loads, respectively, to provide continuous alternate actuation of the loads and whereby when said first charge storage device is coupled to discharge through a first load to provide a peak initial current said second charge storage device is charged and when said second charge storage device is coupled to discharge through a second load to provide a peak initial current said first charge storage device is charged.

2. The circuit as defined in claim 1 and further including a holding current power supply and means for coupling said holding current power supply to said first and second charge storage devices for providing a holding current to the first and second loads.

3. The circuit as defined in claim 2 wherein when said first charge storage device is coupled to discharge through a first load to provide an initial peak current thereto, said second charge storage device is coupled to be charged in part by said voltage doubling charge storage device and when said second charge storage device is coupled to discharge through a second load to provide an initial peak current thereto, said first charge storage device is coupled to be charged in part by said voltage doubling charge storage device.

4. The circuit as defined in claim 3 wherein said unidirectional conductive devices comprise diodes.

5. The circuit as defined in claim 4 wherein said charge storage devices comprise capacitors.

6. The circuit as defined in claim 5 wherein said switch means comprise solid state switches and further including trigger circuit means coupled to said solid state switches for alternately actuating said switches.

7. The circuit as defined in claim 6 and further including first and second inductive loads coupled to said first and second solid state switches.

8. The circuit as defined in claim 7 and further including detector means for detecting the position of an object to be controllably moved by the actuation of said first and second inductive loads, said detector means coupled to said trigger circuit for providing a control signal thereto, said trigger circuit being responsive to said control signal to selectively control said solid state switches.

9. The circuit as defined in claim 8 wherein said solid state switches comprise SCRs.

10. The circuit as defined in claim 9 wherein said holding current power supply is a DC supply and wherein said means for coupling said holding current power supply to said first and second charge storage device comprises a pair of steering diodes.

11. A control circuit for alternately and repetitively actuating a pair of loads employed in a continuous manufacturing process comprising:

a first and second pair of outputs for coupling said circuit to first and second loads, respectively;

a source of AC current;

a voltage doubling capacitor coupled to said source;

a first capacitor coupled to said first pair of outputs;

a first pair of diodes coupling said source of AC current to said first capacitor in a voltage doubling circuit;

a second capacitor coupled to said second pair of outputs;

a second pair of diodes coupling said source of AC current to said second capacitor in a voltage doubling circuit; and first and second switch means for alternately coupling said first and second capacitors to first and second loads, respectively, whereby when said first capacitor is coupled to discharge through a first load to provide a peak initial current said second capacitor is charged and when said second capacitor is coupled to discharge through a second load to provide a peak initial current said first capacitor is charged.

12. The circuit as defined in claim 11 and further including a holding current power supply coupled to said outputs for applying a holding current to the loads coupled thereto by said first and second switch means.

13. The circuit as defined in claim 12 wherein said source of AC current comprises a transformer having a secondary winding with first and second terminals and wherein said voltage doubling capacitor has one terminal coupled to said first terminal of said secondary winding and wherein said first pair of diodes are coupled with a first diode of said first pair of diodes having an anode coupled to the remaining terminal of said voltage doubling capacitor and to the cathode of the second diode of said first pair of diodes and wherein the cathode of said first diode of said first pair of diodes is coupled to one terminal of said first capacitor and the remaining terminal of said first capacitor is coupled to the anode of said second diode of said first pair of diodes and the second terminal of said secondary winding is coupled to said second pair of diodes.

14. A control circuit for alternately actuating a pair of loads comprising:

a first and second pair of outputs for coupling said circuit to first and second loads, respectively;

a source of AC current;

a voltage doubling capacitor coupled to said source;

a first capacitor coupled to said first pair of outputs;

a first pair of diodes coupling said source of AC current to said first capacitor in a voltage doubling circuit;

a second capacitor coupled to said second pair of outputs;

a second pair of diodes coupling said source of AC current to said second capacitor in a voltage doubling circuit;

first and second switch means for alternately coupling said first and second capacitors to first and second loads, respectively, whereby when said first capacitor is coupled to discharge through a first load to provide a peak initial current said second capacitor is charged and when said second capacitor is coupled to discharge through a second load to provide a peak initial current said first capacitor is charged; and a holding current power supply coupled to said outputs for applying a holding current to the loads coupled thereto by said first and second switch means, wherein said source of AC current comprises a transformer having a secondary winding with first and second terminals and wherein said voltage doubling capacitor has one terminal coupled to said first terminal of said secondary winding and wherein said first pair of diodes are coupled with a first diode of said first pair of diodes having an anode coupled to the remaining terminal of said voltage doubling capacitor and to the cathode of the second diode of said first pair of diodes and wherein the cathode of said first diode of said first pair of diodes is coupled to one terminal of said first capacitor and the remaining terminal of said first capacitor is coupled to the anode of said second diode of said first pair of diodes and the second terminal of said secondary winding is coupled to said second pair of diodes, and wherein the second terminal of said secondary winding is coupled to the anode of a first diode of said second pair of diodes and to the cathode of a second diode of said second pair of diodes, and the cathode of said first diode of second pair of diodes is coupled to one terminal of said second capacitor having its remaining terminal coupled to the anodes of said second diodes of said first and second pairs of diodes.

15. The circuit as defined in claim 14 wherein said switch means comprise solid state switches and further including trigger circuit means coupled to said solid state switches for alternately actuating said switches.

16. The circuit as defined in claim 15 and further including first and second inductive loads coupled to said first and second solid state switches.

17. The circuit as defined in claim 16 and further including detector means for detecting the position of an object to be controllably moved by the actuation of said first and second inductive loads, said detector means coupled to said trigger circuit for providing a control signal thereto, said trigger circuit being responsive to said control signal to selectively control said solid state switches.

18. The circuit as defined in claim 17 wherein said solid state switches comprise SCRs.

19. The circuit as defined in claim 18 wherein said holding current power supply is a DC supply and a pair of steering diodes couple said supply to said outputs.

* * * * *